US008024929B2

(12) United States Patent
Marnoch

(10) Patent No.: US 8,024,929 B2
(45) **Date of Patent: *Sep. 27, 2011**

(54) THERMAL CONVERSION DEVICE AND PROCESS

(75) Inventor: Ian A. Marnoch, Markham (CA)

(73) Assignee: Ian Marnoch, Markham, Ontario (CA)

( * ) Notice: Subject to any disclaimer, the term of this patent is extended or adjusted under 35 U.S.C. 154(b) by 60 days.

This patent is subject to a terminal disclaimer.

(21) Appl. No.: 11/958,575

(22) Filed: Dec. 18, 2007

(65) Prior Publication Data

US 2008/0127649 A1 Jun. 5, 2008

Related U.S. Application Data

(63) Continuation of application No. 10/798,290, filed on Mar. 12, 2004, now Pat. No. 7,331,180.

(51) Int. Cl.
*F01K 25/02* (2006.01)

(52) U.S. Cl. ..... 60/650; 60/682

(58) Field of Classification Search ..... 60/650, 60/682–683

See application file for complete search history.

(56) References Cited

U.S. PATENT DOCUMENTS

| | | | | |
|---|---|---|---|---|
| 2,164,134 A | | 6/1939 | Hähnle | |
| 3,055,170 A | | 9/1962 | Westcott | |
| 3,183,672 A | | 5/1965 | Morgan | |
| 3,888,084 A | * | 6/1975 | Hawkins | 60/614 |
| 3,937,019 A | | 2/1976 | Renner | |
| 3,995,429 A | | 12/1976 | Peters | |
| 3,998,056 A | | 12/1976 | Clark | |
| 4,027,480 A | | 6/1977 | Rhodes | |
| 4,107,928 A | | 8/1978 | Kelly et al. | |
| 4,134,265 A | | 1/1979 | Schlueter | |

(Continued)

FOREIGN PATENT DOCUMENTS

CA 1125525 6/1982

(Continued)

*Primary Examiner* — Hoang M Nguyen

(74) *Attorney, Agent, or Firm* — Etienne de Villiers; Dimock Stratton LLP

(57) ABSTRACT

An apparatus and method for converting a differential in thermal energy between a first thermal source having a thermal conducting fluid and a second thermal source having a thermal conducting fluid is provided. The apparatus employs a first vessel and a second vessel. Each of the vessels contain a gas under pressure The vessels contain heat exchanging coils that are connected to the thermal sources by fluid lines. A plurality of cooperating valves regulate the flow of the thermal conducting fluid from the first and second thermal sources to the first and second vessels. The valves alternate between first and second operating positions. In the first position, the valves permit a flow of thermal conducting fluid from the first thermal source to the first vessel and from the second thermal source to the second vessel and prevent a flow of thermal conducting fluid from the first thermal source to the second vessel and from the second thermal source to the first vessel. In the second position, the valves permit a flow of thermal conducting fluid from the first thermal source to the second vessel and from the second thermal source to the first vessel and prevent a flow of thermal energy from the first thermal source to the first vessel and from the second thermal source to the second vessel. A pressure driven actuator in fluid communication with the first and second vessels is driven into reciprocating motion between a first position and a second position by alternating positive pressure and negative pressure from the first and second vessels.

4 Claims, 8 Drawing Sheets

U.S. PATENT DOCUMENTS

| | | | | | |
|---|---|---|---|---|---|
| 4,170,878 | A | | 10/1979 | Jahnig | |
| 4,195,481 | A | * | 4/1980 | Gregory | 60/516 |
| 4,233,813 | A | | 11/1980 | Simmons | |
| 4,283,915 | A | | 8/1981 | McConnell et al. | |
| 4,429,536 | A | * | 2/1984 | Nozawa | 60/655 |
| 4,452,047 | A | | 6/1984 | Hunt et al. | |
| 4,458,488 | A | | 7/1984 | Negishi | |
| 4,489,554 | A | * | 12/1984 | Otters | 60/518 |
| 4,509,329 | A | | 4/1985 | Breston | |
| 4,553,394 | A | | 11/1985 | Weinert | |
| 4,637,211 | A | | 1/1987 | White et al. | |
| 4,747,271 | A | | 5/1988 | Fischer | |
| 5,195,321 | A | | 3/1993 | Howard | |
| 5,548,957 | A | * | 8/1996 | Salemie | 60/641.8 |
| 5,579,640 | A | * | 12/1996 | Gray et al. | 60/413 |
| 5,598,704 | A | | 2/1997 | Sidaway | |
| 5,613,362 | A | * | 3/1997 | Dixon | 60/649 |
| 5,916,140 | A | | 6/1999 | Hageman | |
| 5,934,076 | A | | 8/1999 | Coney | |
| 6,240,729 | B1 | | 6/2001 | Yoo et al. | |
| 6,691,514 | B2 | * | 2/2004 | Bushey | 60/651 |
| 6,848,258 | B1 | * | 2/2005 | Speece | 60/649 |
| 7,019,412 | B2 | * | 3/2006 | Ruggieri et al. | 290/2 |
| 7,331,180 | B2 | * | 2/2008 | Marnoch | 60/645 |
| 2003/0192315 | A1 | | 10/2003 | Corcoran | |

FOREIGN PATENT DOCUMENTS

| | | |
|---|---|---|
| CA | 2150359 | 6/1994 |
| CA | 2263727 | 2/1998 |

* cited by examiner

THERMAL CONVERSION DEVICE AND PROCESS

FIELD OF THE INVENTION

The invention relates to devices and methods for converting thermal energy into kinetic energy especially for the production and/or storage of electrical energy.

BACKGROUND OF THE INVENTION

Given society's ever increasing energy consumption, there is a resultant high demand for energy. Since the earth's natural energy reserves are becoming depleted and prices of oil and natural gas are relatively high, there is a demand for new sources of energy.

There have been attempts to convert existing forms of energy into forms of energy that can be used to satisfy our energy needs. Many of these processes harness energy sources that are replenished by natural processes. These energy sources are referred to as renewable energy sources. An example is solar energy where energy from the sun in the form of heat energy and light energy is converted into electrical energy. However, sunlight is a weak energy source compared to traditional energy sources such as fossil fuels. It is very difficult to harness sunlight efficiently for conversion into useful forms of energy. It is particularly difficult to use sunlight effectively for home energy needs. Energy requirements are usually highest when it is dark and cold. This is precisely when solar energy is least effective. Solar energy becomes much more useful when we change it to another form. Sunlight can be converted to electricity by photovoltaic cells. However, this conversion is inefficient and high in cost. Also, some types of photovoltaic solar cells contain mercury that is highly toxic.

Other renewable energy sources have the drawback of being environmentally unfriendly. For example, wind power plants can damage local animal populations. Also, hydroelectric dams can cause problems such as the creation of large reservoirs. This can upset the ecological balance of the surrounding environment. This has the consequences of disrupting local animal populations and their migration patterns. Dams also affect fish populations.

It would therefore be desirable to be able to harness existing forms of energy in an effective and environmentally friendly manner. It has been recognized that it would be desirable to convert naturally occurring heat sources into useable forms of energy. There have been a number of attempts to convert low-level heat sources into mechanical energy. These methods employ the principle of expansion and contraction of a working fluid, utilizing a heat source to add and remove heat from the working fluid. These methods have the drawback of failing to obtain a sufficient concentration of heat to activate the process in an efficient manner. Such methods to date have failed to produce an economically viable energy generation process.

U.S. Pat. No. 4,134,265 provides an example of such a prior art process. This patent discloses a method for developing gas pressure to drive an engine. The method involves the use of a plurality of separate containers in a closed circuit. The tanks communicate with heat exchangers that are arranged in combination with certain controls to create pressure variations on a given volume of gas by varying the gas temperatures. The tanks are used in pairs with the gas in one tank being cooled while the other gas in the other tank is heated to develop a pressure differential therebetween. Controlled communication between the tanks produces flow to one of the tanks with an increase in mass of gas therein and followed by a second development of gas differential pressure. The gas is released for communication with a piston to produce a work stroke.

U.S. Pat. No. 3,995,429 provides another example of a prior art process that fails to produce an economically viable energy generation system. The patent discloses a system of generating electric power derived from the energy of the sun, the atmosphere, the ground or the heat stored in ground water, whichever provides the greatest temperature differential with another adjacent source of energy. The apparatus generates a fluid vapour pressure for the operation of a vapour engine and includes at least three heat sources. One of the sources is a solar absorber for absorbing the heat from the sun. A second source is a heat exchanger which dissipates the heat of the fluid to the atmosphere. A third source is a radiator positioned in the ground water. A fourth source for transforming ground or geothermal heat to the fluid also for transferring the heat of the ground water to the fluid is provided. Other well-known heat sources may be substituted where available. Valve connecting means are operated to connect any two of the four heat sources in a closed cycle system for the transfer of heat from one source to another. Pumping means are provided for forcing fluid through the system to a source where the fluid is vaporized. A transducer such as a turbine or piston engine connected to the heat source vaporizes the fluid that produces the mechanical power.

There have been attempts to harness naturally occurring temperature gradients. An example is Ocean Thermal Energy Conversion. A significant amount of financial resources have been invested in pilot plants to harness the surface heat of the world's oceans by making use of temperature gradients between the warm surface and cold depths. This has not yielded an economically viable method for energy production.

There is therefore a need for an apparatus and method for converting thermal energy into mechanical and electrical energy in an environmentally friendly efficient, and economically viable manner. There is a need for such an apparatus and method that can utilize a very low temperature differential to produce energy efficiently.

SUMMARY OF THE INVENTION

The invention provides a method of extracting a differential in thermal energy between a first thermal source and a second thermal source and converting this energy into mechanical energy that can be used to generate electrical energy for energy storage or direct use or to feed into a power grid. The thermal sources are put in fluid communication with two vessels containing a gas under pressure. The thermal sources have thermal values that are different than the thermal values of the vessels. The thermal sources are used to alternately increase the temperature and pressure in one of the vessels and decrease the temperature and pressure in the other vessel. A pressure driven actuator is moved in a single direction by the resultant pressure released by the first vessel and suction from the second vessel.

According to another aspect of the invention, there is provided an apparatus for extracting a differential in thermal energy between a first thermal source and a second thermal source and converting this energy into mechanical energy is provided. The apparatus has first and second vessels that include a gas under pressure. The thermal sources are in fluid communication with the two vessels. The thermal sources have thermal values that are different than the thermal values of the vessels. The thermal sources are adapted to alternately increase the temperature and pressure in one of the vessels while decreasing the temperature and pressure in the other vessel. A pressure driven actuator coupled to the vessels and is moved in a single direction by pressure released by the first vessel and suction from the second vessel. The pressure driven actuator may be coupled to a piston and cylinder assembly or a rotary actuator in order to transfer mechanical energy thereto.

An apparatus for converting a differential in thermal energy between a first thermal source having a thermal conducting fluid and a second thermal source having a thermal conducting fluid, the apparatus comprising:

a first vessel for containing a gas under pressure, the first vessel being in fluid communication with said first and second thermal sources;

a second vessel for containing a gas under pressure, the second vessel being in fluid communication with said first and second thermal sources;

a plurality of cooperating valves for alternately regulating a flow of thermal conducting fluid from the first and second thermal sources to the first and second vessels, the plurality of cooperating valves alternating between first and second operating positions, the plurality of cooperating valves permitting a flow of thermal conducting fluid from the first thermal source to the first vessel and from the second thermal source to the second vessel in first operating position, the plurality of cooperating valves preventing a flow of thermal conducting fluid from the first thermal source to the second vessel and from the second thermal source to the first vessel in the first operating position, the plurality of cooperating valves permitting a flow of thermal conducting fluid from the first thermal source to the second vessel and from the second thermal source to the first vessel in the second operating position, the plurality of cooperating valves preventing a flow of thermal conducting fluid from the first thermal source to the first vessel and from the second thermal source to the second vessel in the second operating position;

a pressure driven actuator in fluid communication with the first and second vessels whereby the actuator is driven into reciprocating motion between a first position and a second position by alternating positive pressure and negative pressure from the first and second vessels wherein positive pressure from the first vessel coupled with negative pressure from the second vessel when the plurality of cooperating valves is in the first operating position drives the actuator to the first position and negative pressure from the first vessel coupled with positive pressure form the second vessel when the plurality of cooperating valves is in the second operating position drives the actuator to the second position.

According to another aspect of the present invention there is provided a method for converting a differential in thermal energy to kinetic energy comprising the following steps:

providing first and second vessels containing a gas under pressure, the gas under pressure being of a temperature T;

providing a first thermal source and a second thermal source, the first thermal source housing a thermal transfer fluid of a temperature above T and the second thermal source housing a thermal transfer fluid of a temperature below T.

delivering the thermal transfer fluid from the first thermal source to the first vessel thereby raising the pressure of the gas in the first vessel;

delivering the thermal transfer fluid from the second thermal source to the second vessel thereby lowering the pressure of the gas in the second vessel;

delivering gas under pressure from the first vessel to a pressure activated actuator and applying suction from the second vessel to the pressure activated actuator thereby causing the pressure activated actuator to move in a first direction.

BRIEF DESCRIPTION OF THE DRAWINGS

In drawings which illustrate by way of example only a preferred embodiment of the invention.

DETAILED DESCRIPTION OF THE INVENTION

The present invention provides an apparatus for converting a differential in thermal energy between two thermal sources into mechanical energy that can be used for a wide range of applications known to a person skilled in the art including the generation and storage of electrical energy. The invention also relates to a method of converting a differential in thermal energy between two thermal sources into mechanical energy. The method can be carried out with the apparatus of the present invention.

Figure 1:
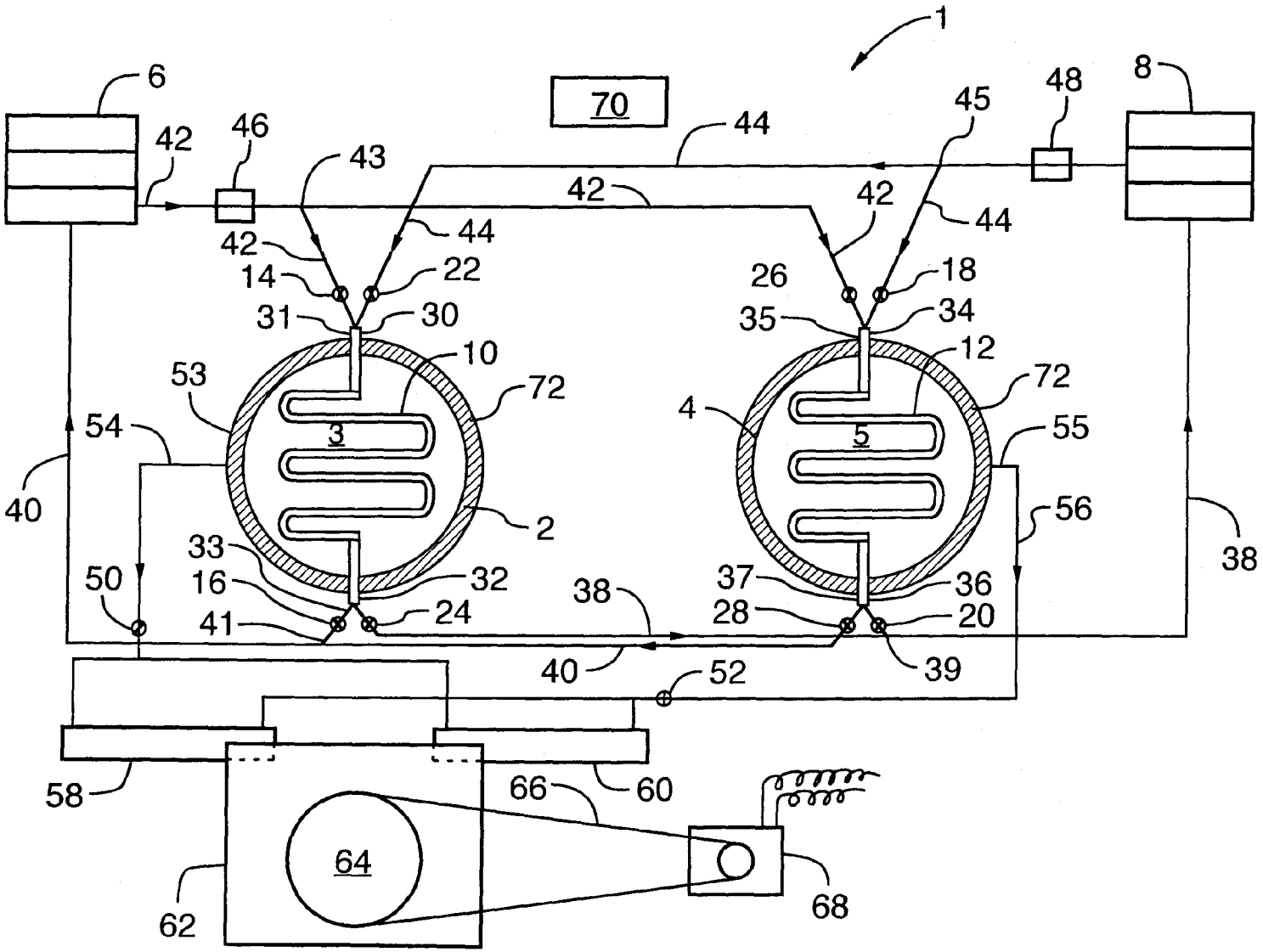
FIG. 1 is a schematic illustration of a preferred embodiment of the present invention.
Figure 2:
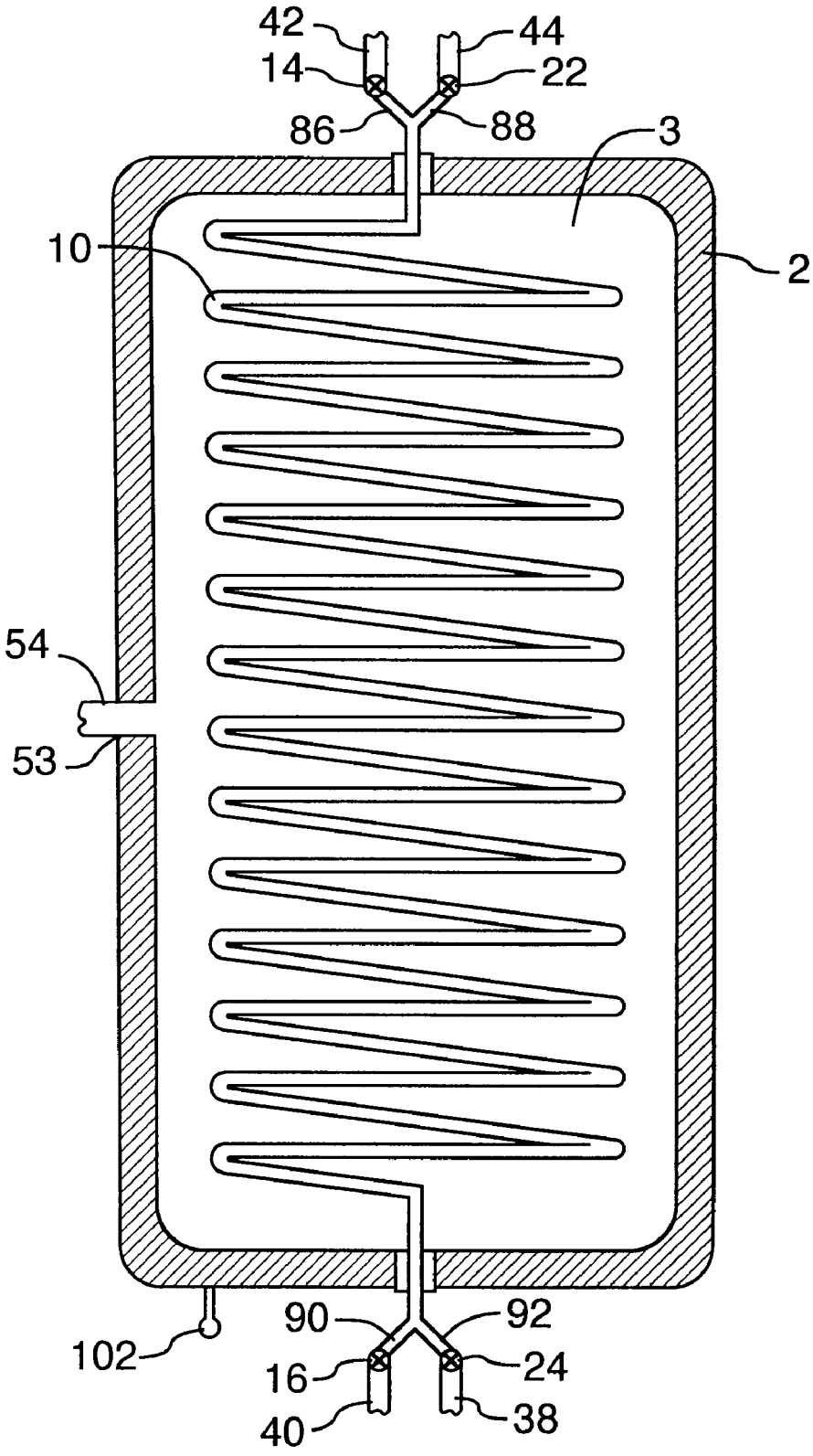
FIG. 2 is a longitudinal cross-sectional view taken along lines 2-2 of FIG. 1 of a first vessel of the present invention.
Figure 3:
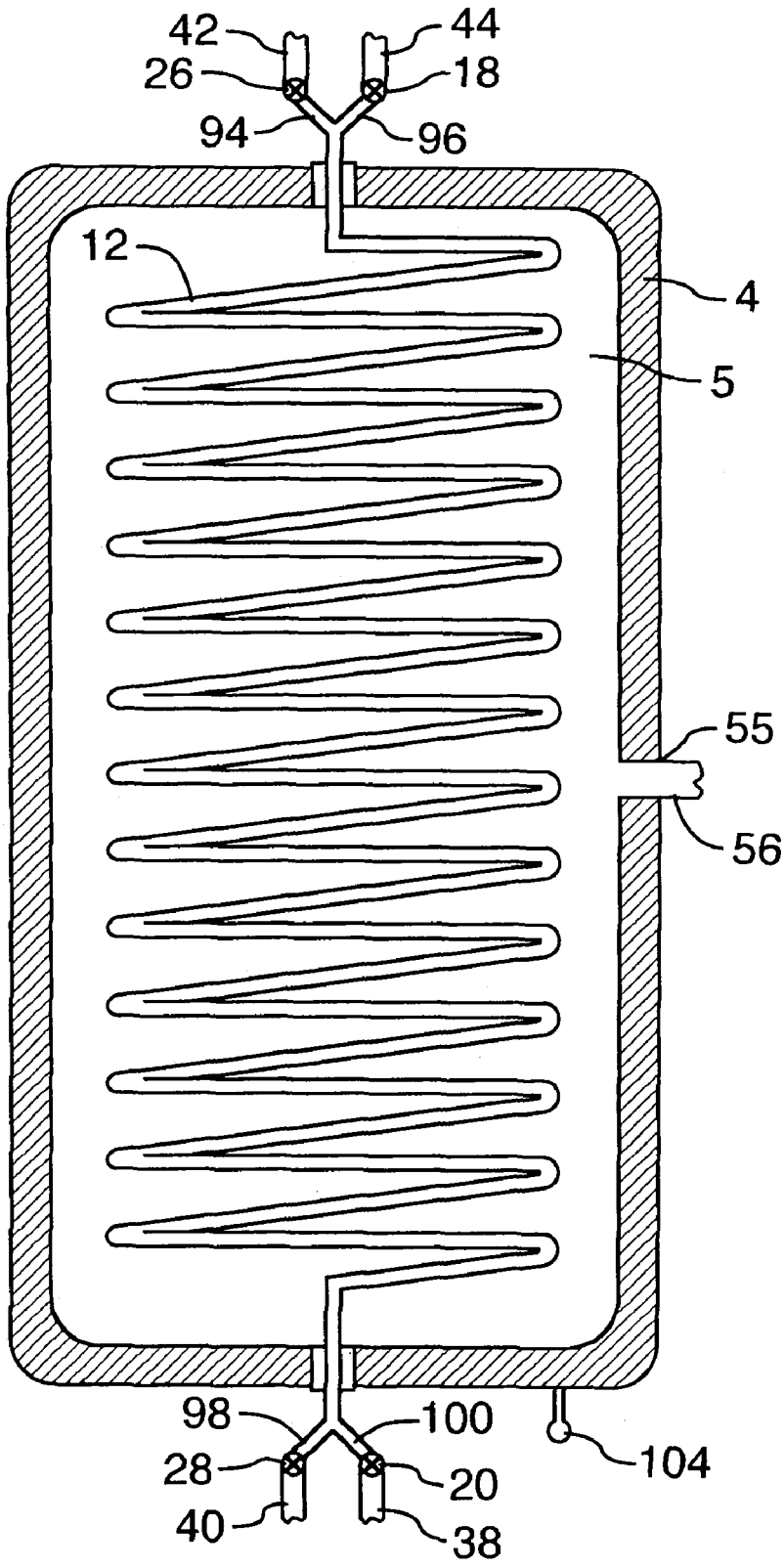
FIG. 3 is a longitudinal cross-sectional view taken along lines 3-3 of FIG. 1 of a second vessel of the present invention.

A preferred embodiment of the present is shown in FIG. 1. Apparatus 1 includes a first vessel 2 and a second vessel 4. Each of the two vessels is preferably a sealed container that defines a chamber therein for containing a gas under pressure. As shown in FIGS. 2 and 3, the first vessel 2 defines a chamber 3 and the second vessel 4 defines a chamber 5. The vessels contain the gas under pressure in the chambers. The vessels are shown in lateral cross section in FIG. 1 and in longitudinal cross-section in FIGS. 2 and 3. Each of the vessels preferably has an insulating jacket 72 for preventing thermal exchange with the ambient environment.

The first vessel 2 has heat exchange conduit 10 located in the chamber 3. The conduit 10 is preferably coiled copper tubing that is adapted to conduct a fluid. Other conduits known in the art to have favourable heat exchanging properties may also be employed in alternate embodiments. The conduit 10 has a first end 30 that communicates with the exterior of the vessel 2 through an opening 31 defined by the vessel 2. The conduit 10 has a second end 32 that communicates with the exterior of the vessel 2 through an opening 33 defined by the vessel 2. Similarly, the second vessel 4 has heat exchange conduit 12 located in the chamber 5. The conduit 12 is also preferably coiled copper tubing that is adapted to conduct a fluid. Again, other conduits known in the art to have favourable heat exchanging properties may also be employed in alternate embodiments. The conduit 12 has a first end 34 that communicates with the exterior of the vessel 4 through an opening 35 defined by the vessel 4. The conduit 12 has a second end 36 that communicates with the exterior of the vessel 4 through an opening 37 defined by the vessel 12. Vessel 2 has a pressure sensor 102. Vessel 4 has a pressure sensor 104.

Figure 4:
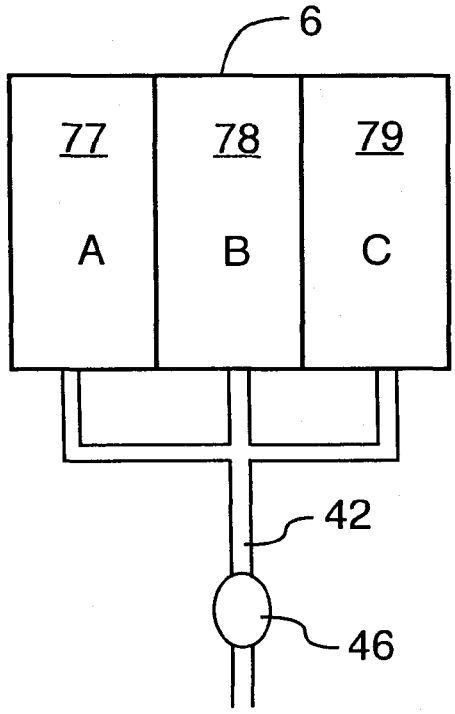
FIG. 4 is a front view of a first thermal source of the present invention.
Figure 5:
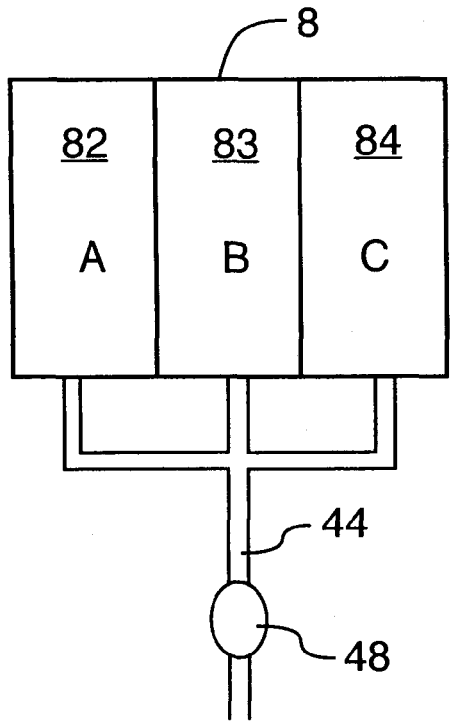
FIG. 5 is a front view of a second thermal source of the present invention.

The apparatus 1 further includes a first thermal unit 6 and a second thermal unit 8. The thermal units are shown in FIGS. 1, 4 and 5. Each of the thermal units is preferably a container that can receive a thermal delivery fluid. Preferably, the container is an insulated container that is of metal, plastic or fibreglass construction. Preferably, each of the thermal units defines a channel running therethrough for passage of the thermal conducting fluid. The thermal delivery fluid is preferably an environmentally suitable fluid of the type required in ground source closed loop heat pumps. However, other fluids with good thermal conductivity properties known in the art may also be used in other embodiments.

The thermal units 6, 8 preferably have a heat exchanger that is in thermal communication with the thermal fluid in order to transfer the temperature of the thermal unit to the thermal fluid. The thermal source can be any medium that is capable of storing or transferring thermal energy. Examples of acceptable thermal sources for the purposes of the present invention include ambient outside air, outside soil, water heated by energy produced by natural gas combustion, wood combustion, solar energy or energy provided by a thermal heat pump. The first thermal unit preferably has a plurality of thermal sources 77,78,79 while the second thermal unit thermal unit preferably has a plurality of thermal sources 82,83,84. As shown in FIG. 4, the thermal source 77 can be outside air with a heat exchanger coil in direct contact with the air. The thermal source 78 in such a case could be a hot water tank heated by natural gas, wood combustion, solar energy or a geothermal heat pump. In this case, there would be two heat exchangers in the tank.

A first heat exchanger would transfer heat to the thermal fluid and a second heat exchanger would be connected to the heat source. Thermal source 79 could be direct contact heat exchanger embedded in soil or a body of water. As shown in FIG. 5, thermal source 82 can be outside air with a heat exchanger coil in direct contact with the ambient air. The thermal source 83 could be a cool water tank cooled by a geothermal heat pump operating in reverse by extracting heat from the thermal fluid, The thermal source 84 could be a direct contact heat exchanger thermal source embedded in soil or a body of water.

Preferably, the first thermal unit 6 uses thermal sources that provide a warm thermal source while the second thermal unit 8 preferably uses thermal sources that provide a cold thermal source. In other embodiments, it is possible that the thermal unit 8 contains the warm thermal sources while thermal unit 6 contains the cold thermal sources. A controller 70 controls from which of the compartments thermal conducting fluid will be dispensed.

A thermal fluid conducting conduit 42 communicates between the thermal source 6 and the first vessel 2. The conduit 42 further communicates between thermal unit 6 and the second vessel 4. A fork 43 in the conduit 42 separates the conduit into a first branch leading to the first vessel 2 and a second branch leading to the second vessel 4. The conduit 42 is received by in-pipe 86 that leads into the first end 30 of the thermal exchange conduit 10. The conduit 42 is also received by in-pipe 94 that leads into the first end 34 of the heat exchange conduit 12. A thermal fluid-conducting conduit 44 communicates between the thermal source 8 and the second vessel 4. The conduit 44 further communicates between thermal unit 8 and the first vessel 2. A fork 45 in the conduit 44 separates the conduit into a first branch leading to the first vessel 2 and a second branch leading to the second vessel 4. The conduit 44 is received by in-pipe 96 that leads into the first end 34 of the heat exchange conduit 12. The conduit 44 is also received by in-pipe 88 that leads into the first end 30 of the heat exchange conduit 10.

A thermal fluid-conducting conduit 38 communicates between the first vessel 2 and the thermal source 8. The conduit 38 further communicates between the second vessel 4 and the thermal source 8. A fork 39 in the conduit 38 separates the conduit into a branch leading from the first vessel 2 and another branch leading from the second vessel 4. The conduit 38 is received by out-pipe 92 that leads from the second end 32 of the heat exchange conduit 10. The conduit 38 is also received by out-pipe 100 that leads from the second end 36 of the heat exchange conduit 12. A thermal fluid-conducting conduit 40 communicates between the first vessel 2 and the thermal source 6. The conduit 40 further communicates between the second vessel 4 and the thermal source 6. A fork 41 in the conduit 40 separates the conduit into a branch leading from the first vessel 2 and another branch leading from the second vessel 4. The conduit 40 is received by out-pipe 90 that leads from the second end 32 of the heat exchange conduit 10. The conduit 40 is also received by out-pipe 98 that leads from the second end 36 of the heat exchange conduit 12.

The thermal fluid conducting conduits are preferably made of insulated synthetic polymer or metal tubing which meets the standards of local building codes.

A first valve 14 controls the flow of fluid from the thermal unit 6 to the conduit 10. A second valve 26 controls the flow of fluid from the thermal unit 6 to the conduit 12. A third valve 22 controls the flow of fluid from the thermal unit 8 to the conduit 10. A fourth valve 18 controls the flow of fluid from the thermal unit 8 to the conduit 12. A fifth valve 16 controls the flow of fluid from the conduit 10 to the thermal unit 6. A sixth valve 24 controls the flow of fluid from the conduit 10 to the thermal unit 8. A seventh valve 28 controls the flow of fluid from the conduit 12 to the thermal unit 6. An eighth valve 20 controls the flow of fluid from the conduit 12 to the thermal unit 8. Preferably the valves are solenoid valves although other valves known in the art may also be employed. Controller 70 is operatively connected to the valves for opening and closing the valves as required to carry out the method of the present invention. The eight valves described herein together with the controller comprise a plurality of cooperating valves for alternately regulating a flow of thermal energy from the first and second thermal sources to the first and second vessels.

Preferably, pump 46 and pump 48 pump the thermal fluid through the thermal fluid conducting conduits. The pumps 46, 48 are preferably circulating pumps of the type used in solar or geothermal applications.

Vessel 2 further defines an opening 53. A pressure conduit 54 is received in the opening 53 and communicates between the chamber 3 and the exterior of the vessel 2 for delivering gas from the chamber 3 to the exterior and vice versa. Similarly vessel 4 further defines an opening 55. A pressure conduit 56 communicates between the chamber 5 and the exterior of the vessel 4 for delivering gas from the chamber to the exterior and vice versa.

Figure 6:
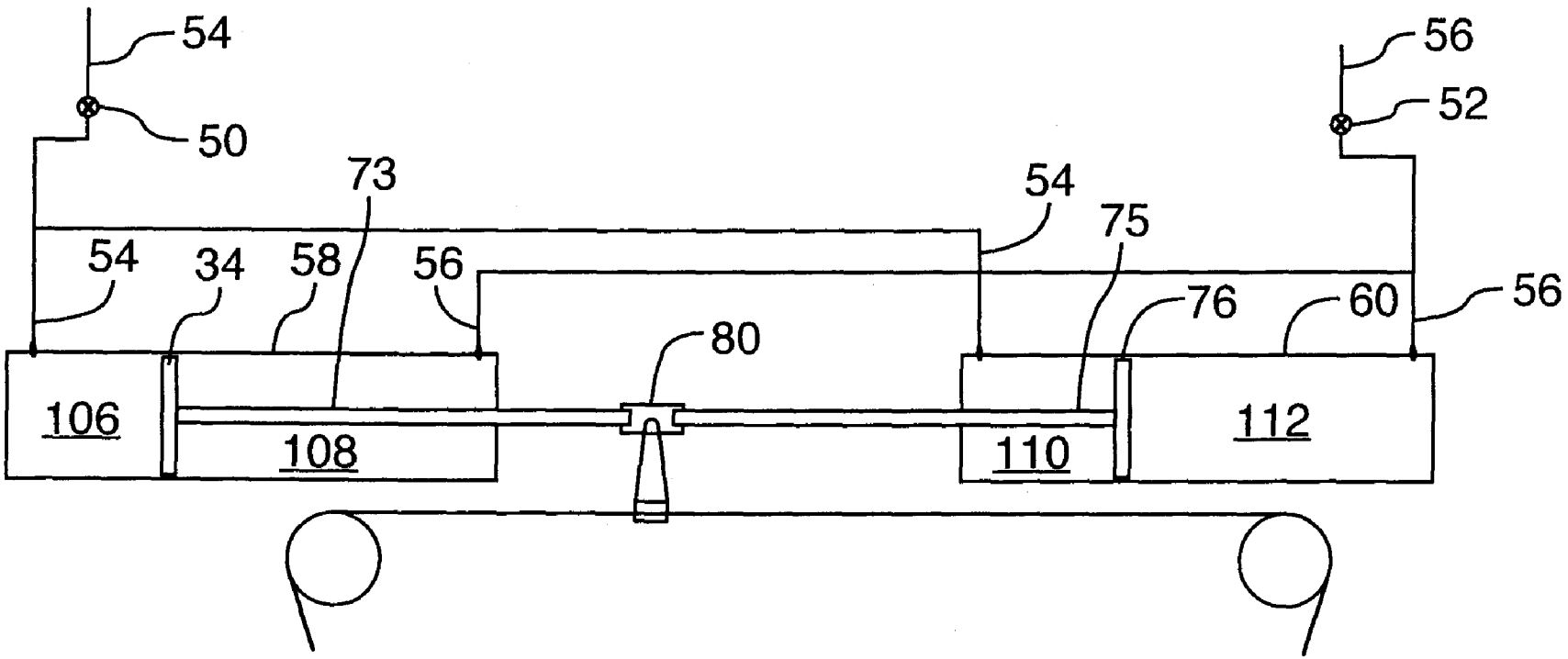
FIG. 6 is a front view with portions cut away showing a pneumatic cylinder of the present invention.

As shown in FIG. 6, each of the pressure conduits 54,56 preferably communicates with pneumatic cylinder 58 and pneumatic cylinder 60. The pneumatic cylinder 58 has a piston 74 moveably received therein while the pneumatic cylinder 60 has a piston 76 moveably disposed therein. The pneumatic cylinder 58 defines a first chamber 106 and a second chamber 108. Similarly, the pneumatic cylinder 60 defines a first chamber 110 and a second chamber 112. The piston 74 has a piston rod 73 while the piston 76 has a piston rod 75. Both piston rods are attached to a connecting member 80 as shown in FIG. 5. A valve 50 is located in the pressure conduit 54 between the vessel 2 and the pneumatic cylinders for regulating gas flow. Similarly, valve 52 is located in the pressure conduit 56 between the vessel 4 and the pneumatic cylinders for regulating gas flow.

Connecting member 80 is preferably coupled to a reversing transmission known in the art. The reversing transmission can be coupled to a generator according to methods well known in the art.

Figure 7:
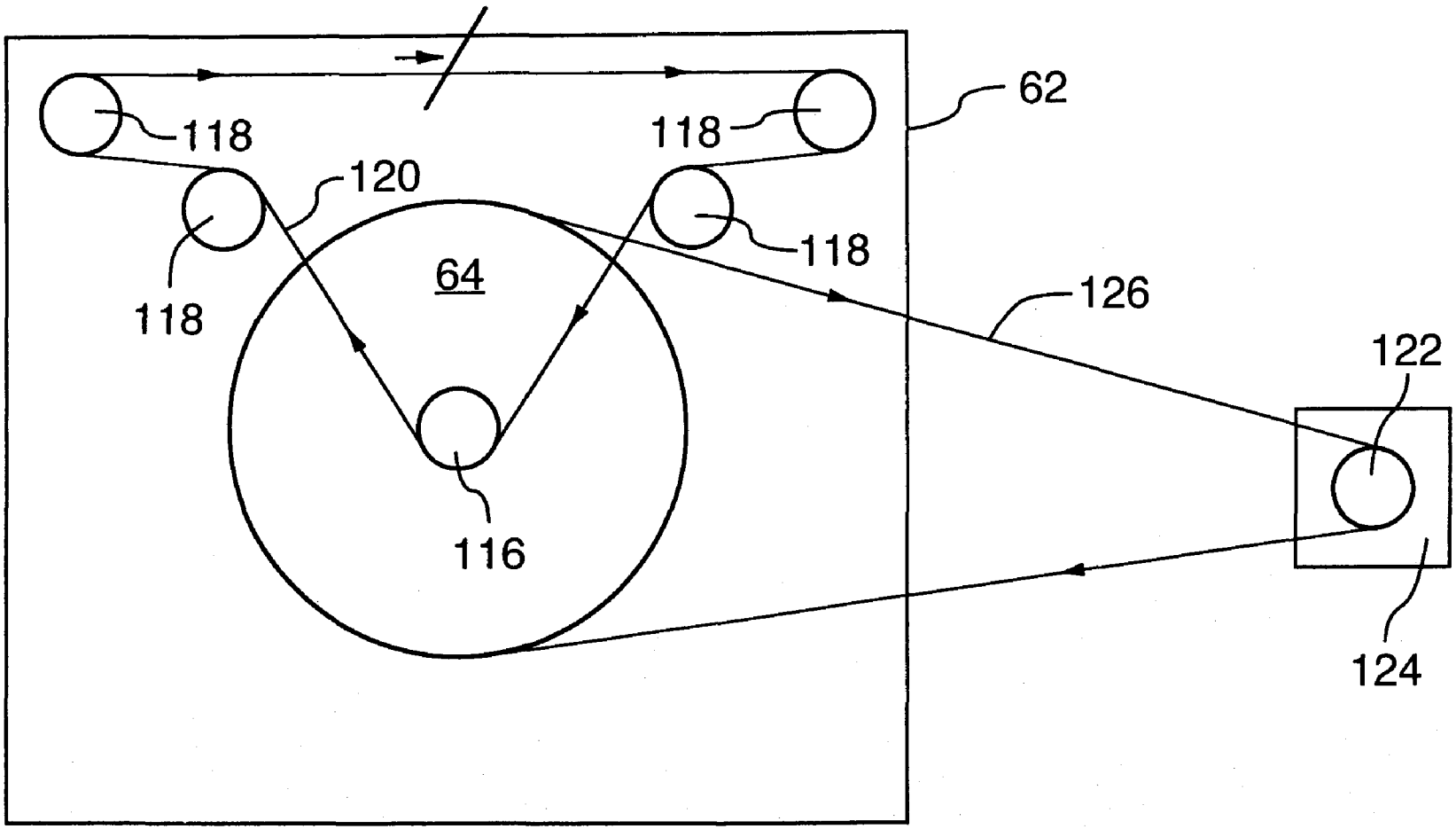
FIG. 7 is a schematic illustration of a first side of reversing transmission of the present invention.
Figure 8:
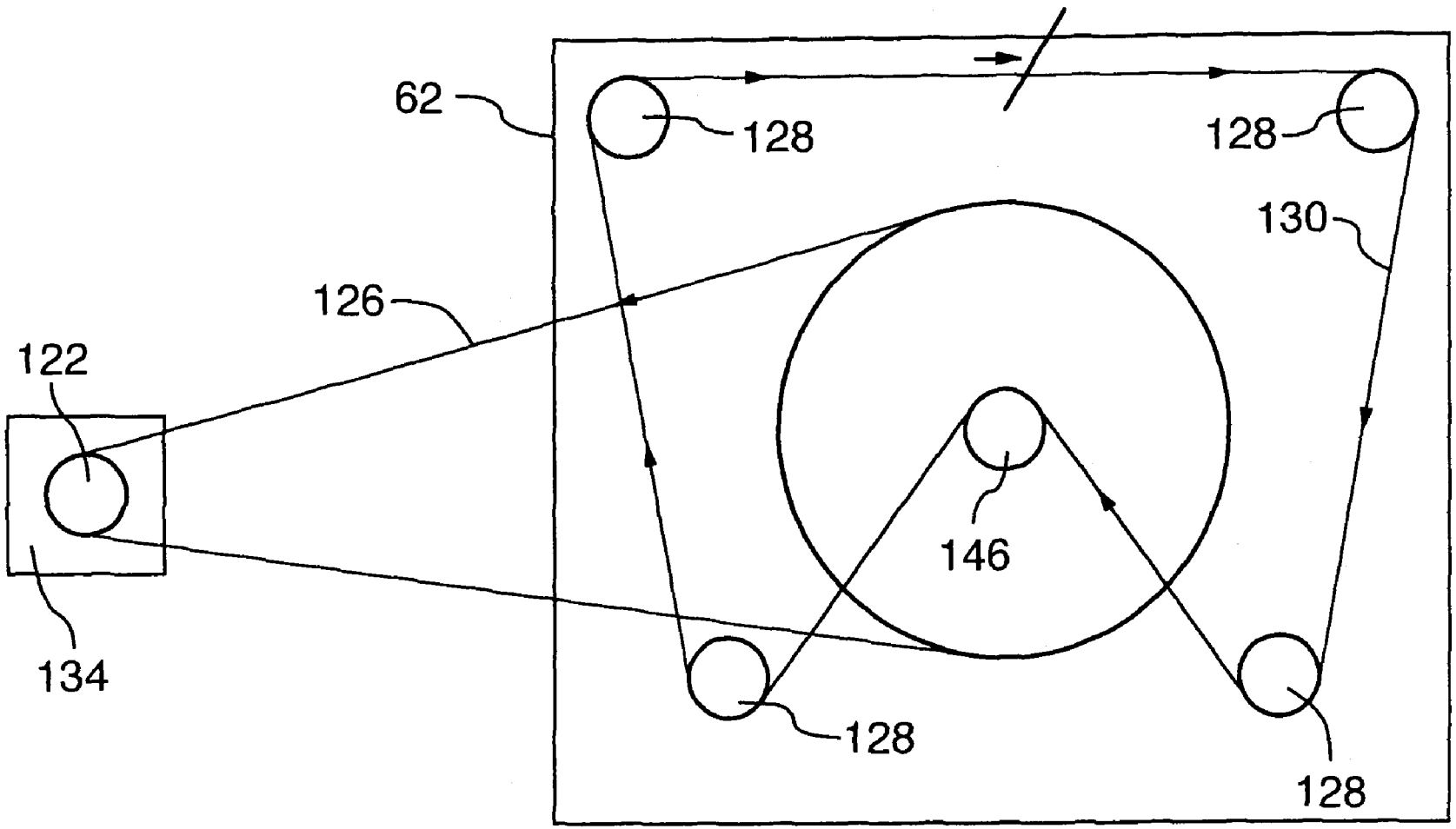
FIG. 8 is a schematic illustration of a second side of a reversing transmission of the present invention.

An example of a basic reversing transmission is shown in FIGS. 7 and 8. These Figures show opposite sides of a flywheel 64 coupled to sprockets 116 and 126 respectively. The transmission includes sprocket pulleys 118 and 128. Transmission chains 120 and 130 are attached to the sprockets 116 and 146 and to the pulleys 118 and 128 respectively. The flywheel 64 is coupled to drive pulley 122 of a generator 124 by way of drive belt 126.

Figure 9:
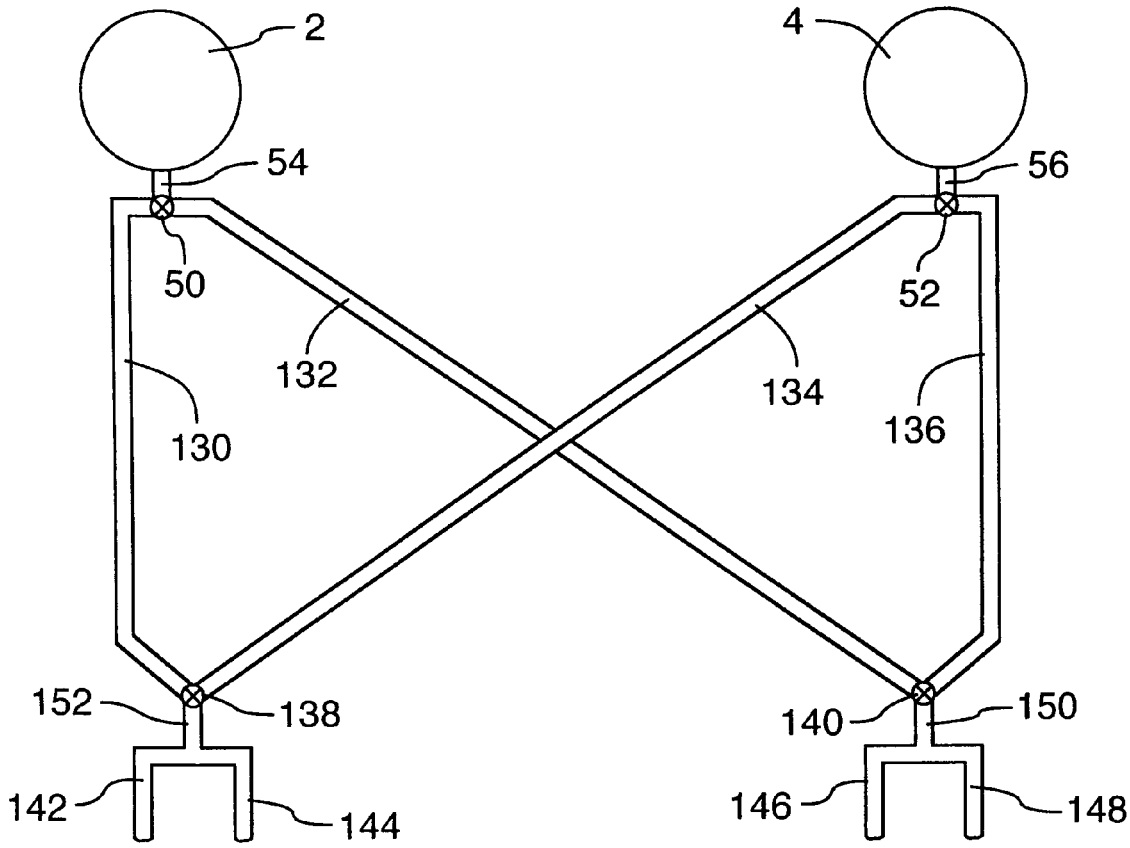
FIG. 9 is a schematic illustration of an alternate embodiment of the present invention.

An alternate embodiment of the invention is shown in FIG. 9. Vessel 2 is connected to the pressure conduit 54. Pressure conduit 54 feeds into pressure conduits 130 and 132. Valve 50 is located between conduit 54 and the conduits 130 and 132. Similarly, vessel 4 is connected to the pressure conduit 56. Pressure conduit 56 feeds into pressure conduits 134 and 136. Valve 52 is located between conduit 56 and the conduits 134 and 136. Valve 138 is located at a junction between conduit 130 and conduit 134. Similarly, valve 140 is located at a junction between conduit 132 and conduit 136. Conduit 130 and conduit 134 join to form conduit 152 that preferably leads to the ports of a double rack rotary actuator. Similarly, conduit 132 and conduit 136 join to form conduit 150 that preferably leads to the ports of the double rack rotary actuator.

In its operation, the apparatus reciprocates between a first operating position and a second operating position thereby driving the pressure-activated actuator into reciprocal motion. This reciprocal motion can be translated into various forms of energy. For example, when the pressure-activated actuator is a pneumatic cylinder the motion can be converted into mechanical or kinetic energy that can in turn be converted into electric potential energy by way of coupling the pneumatic cylinder to a generator.

The controller 70 controls the opening and closing of the valves of the plurality of cooperating valves. To begin the cycle whereby the apparatus moves to the first operating position, the controller opens valve 14 and closes valve 26 so that warm thermal fluid from the thermal unit 6 flows through thermal fluid conduit 42 to in-pipe 86 and into the heat exchange conduit 10 of the vessel 2. As the warm thermal fluid flows through the conduit 10 in the chamber 3, heat is transferred from the conduit to the surrounding gas in the chamber 3. This causes the pressure of the gas to increase. An acceptable pressure range for the purposes of the invention of the gases is approximately 10 p.s.i to 500 p.s.i. The controller opens valve 16 and closes valve 24 so that the thermal fluid can flow through the out-pipe 90 through the thermal fluid conduit 42 and back to the thermal unit 6 where the thermal fluid is re-heated.

In addition to opening valve 14 and closing valve 26, the controller simultaneously opens valve 18 and closes valve 22 so that cool thermal fluid from the thermal unit 8 flows through thermal fluid conduit 44 to in-pipe 96 and into the heat exchange conduit 12 of the vessel 4. As the cool thermal fluid flows through the conduit 12 in the chamber 5, heat is transferred from the surrounding gas in the chamber 5 to the conduit. This causes the pressure of the gas to decrease. The controller opens valve 20 and closes valve 28 so that the thermal fluid can flow through the out-pipe 100. The thermal fluid flows through thermal fluid conduit 38 and back to the thermal unit 8 where the thermal fluid is re-cooled.

When maximum thermal transfer has occurred, in the two vessels after about three seconds, the controller 70 will open the pressure valve 50. The increased pressure in the vessel 2 will cause the gas from the chamber 3 to flow through the pressure conduit 54 and into the first chamber 106 of the pneumatic cylinder 58 and the first chamber 110 of the pneumatic cylinder 60. At the same time, the controller opens the pressure valve 52. The decreased pressure in the vessel 4 will cause the gas from the second chamber 112 of the pneumatic cylinder 60 and the second chamber 108 of the pneumatic cylinder 58 to flow through the pressure conduit 56 and into the chamber 5 of the vessel 4.

In both cases, the gas flow will be in the same direction thereby causing the pistons 74, 76 to move in the same direction. The movement of the pistons causes the piston rods and the connecting member 80 to move in the same lateral direction. The movement of the connecting member 80 causes the transmission chain 120 to move. The transmission chain 120 in turn drives the sprocket 116 and the flywheel 64. Energy from the turning of the flywheel can be transferred to the generator 124.

When the pistons 74, 76 have reached their maximum travel, a sensor at the front of the cylinder 58 will cause the valves 50, 52 to close. The pressure conduits have large enough diameters so as not to restrict the flow to and from the vessels 2,4 which would reduce efficiency. For example, in an embodiment that has a diameter of 1.5 inches for cylinders 58, 60, the pressure conduits would preferably have a minimum diameter of about 0.75 inch.

The cycle whereby the apparatus moves to the second operating position is the direct reverse of the cycle whereby the apparatus moves to the first operating position. To begin the cycle whereby the apparatus moves to the second operating position, the controller opens valve 26 and closes valve 14 is so that warm thermal fluid from the thermal unit 6 flows through thermal fluid conduit 42 to in-pipe 94 and into the heat exchange conduit 12 of the vessel 4. As the warm thermal fluid flows through the conduit 12 in the chamber 5, heat is transferred from the conduit to the surrounding gas in the chamber 5. This causes the pressure of the gas to increase. The controller opens valve 28 and closes valve 20 so that the thermal fluid can flow through the out-pipe 98. The thermal fluid flows through thermal fluid conduit 40 and back to the thermal unit 6 where the thermal fluid is re-heated.

In addition to opening valve 26 and closing valve 14, the controller simultaneously opens valve 22 and closes valve 18 so that that cool thermal fluid from the thermal unit 8 flows through thermal fluid conduit 44 to in-pipe 88 and into the heat exchange conduit 10 of the vessel 2. As the cool thermal fluid flows through the conduit 10 in the chamber 3, heat is transferred from the surrounding gas in the chamber 3 to the conduit 10. This causes the pressure of the gas to decrease. The controller opens valve 24 and closes valve 16 so that the thermal fluid can flow through the out-pipe 92. The thermal fluid flows through thermal fluid conduit 38 and back to the thermal unit 8 where the thermal fluid is re-cooled.

When maximum thermal transfer has occurred, in the two vessels after about three seconds, the controller 70 will open the pressure valve 52. The increased pressure in the vessel 4 will cause the gas from the chamber 5 to flow through the pressure conduit 56 and into the second chamber 112 of the pneumatic cylinder 60 and the second chamber 108 of the pneumatic cylinder 58. At the same time, the controller opens the pressure valve 50. The decreased pressure in the vessel 2 will cause the gas from the first chamber 110 of the pneumatic cylinder 60 and the first chamber 106 of the pneumatic cylinder 58 to flow through the pressure conduit 54 and into the chamber 3 of the vessel 2.

Once again, in both cases, the gas flow will be in the same direction thereby causing the pistons 74, 76 to move in the same direction. In this case the pistons will move in the opposite direction to the direction of their motion in the previous cycle. The movement of the pistons again causes the piston rods and the connecting member 80 to move in the same lateral direction as the direction of the gas flow. The movement of the connecting member 80 causes the transmission chain 120 to move. This drives the sprockets 116 and 126 and the flywheel 64. Energy from the turning of the flywheel can be transferred to the generator 124.

When the pistons 74, 76 have reached their maximum travel, a sensor at the front of the cylinder 56 will cause the valves 50, 52 to close. This cycle continues continuously to cause continuous reciprocation of the pistons.

As will be evident from the description of the preferred embodiment, in its operation, the embodiment shown in FIG. 9 is preferably employed when there is a significant pressure differential between the pressure vessels 2, 4. The additional diversionary valve system shown in FIG. 9 may be used to obtain multiple cycles of the pneumatic cylinders or rotary actuator before initiating the second stage of the process.

At the beginning of the cycle, valves 50 and 52 will be closed. When vessel 2 is heated from one of the heat sources and vessel 4 is cooled from one of the cold sources, valves 50 and 52 will be opened. In the first cycle, valve 138 will be open to pressure conduit 130 and closed to pressure conduit 134. Valve 140 will be open to pressure conduit 136 and closed to pressure conduit 132. Pressure conduits 142 and 144 will deliver the higher-pressure working fluid to first and second ports respectively of cylinders or a rotary actuator. Pressure conduits 146 and 148 will receive the lower pressure working fluid from third and fourth ports respectively of the cylinders or the rotary actuator.

In the second cycle, the valves 50 and 52 will close, and valves 138 and 140 will open to the pressure conduits 132 and 134 respectively. Valves 50 and 52 will then re-open. Pressure conduits 146 and 148 will then deliver higher-pressure working fluid to the third and fourth ports of the cylinders or the rotary actuator.

During the cycles of this alternate embodiment, the mass of the working fluid contained in the cylinders is re-distributed to the lower pressure vessel of the stage. When the pressure equalizes and no additional cycles can be obtained, the process will revert to the second stage. Pressure vessel 4 will then become the high-pressure source and vessel 2 will become the low-pressure receiver of the working fluid.

In an alternate embodiment, the pressure-activated actuator can be a rotary actuator. Other pressure activated actuators known to a person skilled in the art can be used for the purposes of the present invention.

In an alternate embodiment where several pressurized vessels are used, the time for maximum thermal transfer among the vessels to occur can be significantly minimized to the point that this occurs almost instantaneously.

While various embodiments and particular applications of this invention have been shown and described, it is apparent to those skilled in the art that many other modifications and applications of this invention are possible without departing from the inventive concepts herein. It is, therefore, to be understood that, within the scope of the appended claims, this invention may be practiced otherwise than as specifically described, and the invention is not to be restricted except by the scope of the claims.

I claim:

1. An apparatus for converting a differential in thermal energy between a first thermal source having a thermal conducting fluid and a second thermal source having a thermal conducting fluid, the apparatus comprising:

a pair of gas-filled vessels in communication with said first and second thermal sources;

a pressure driven reciprocating actuator comprising a pnematic cylinder defining a first chamber and a second chamber separated by at least one piston moveable within said pneumatic cylinder, said first chamber and said second chamber in fluid communication with said gas-filled vessels;

said pair of gas-filled vessels supplying a gas comprising a working fluid to said first chamber and said second chamber of said pressure driven reciprocating actuator; and, a controller for alternating flow of the thermal energy from the fist and second thermal source between each of the pair of gas-filled vessels to alternately raise and lower pressure of said gas in the vessels to alternately transfer gas from one vessel to a one of the first chamber and the second chamber of the reciprocating actuator and transfer gas from an other of the first chamber and the second chamber of the reciprocating actuator to the other vessel to drive the actuator in reciprocating motion.

2. A method for converting a differential in thermal energy between a first thermal source and a second thermal source to kinetic energy comprising transferring a first thermal energy from the first thermal source to a first vessel and a second thermal energy from the second thermal source to a second vessel, the transfer of energy raising a first pressure of gas in the first vessel and lowering a second pressure of gas in the second vessel, transferring at least some of the gas in the first vessel to a first chamber of a pneumatic cylinder and transferring at least some of the gas from a second chamber of the pneumatic cylinder to the second vessel, the transfer of the gas applying a pressure to the first chamber and a suction to the second chamber, activating a movable piston separating the first chamber from the second chamber to move in a first direction.

3. The apparatus of claim 1 where in the reciprocating actuator is coupled to a reversing transmission for driving a generator.

4. The method of claim 2 wherein after the piston has moved in the first direction, the method further comprising transferring the first thermal energy from the first thermal source to the second vessel and the second thermal energy from the second thermal source to the first vessel, the transfer of energy raising the second pressure of gas in the second vessel and lowering the first pressure of gas in the first vessel, transferring at least some of the gas in the second vessel to the second chamber and transferring at least some of gas from the first chamber to the first vessel, the transfer of the gas activating the piston to move in a second direction.

* * * * *